US006372329B1

(12) United States Patent
Graczyk et al.

(10) Patent No.: US 6,372,329 B1
(45) Date of Patent: Apr. 16, 2002

(54) INK-JET RECORDING MEDIA HAVING INK-RECEPTIVE LAYERS COMPRISING MODIFIED POLY(VINYL ALCOHOLS)

(75) Inventors: Tomasz Graczyk; Khizyr K. Khoultchaev; Boping Xie, all of Branford, CT (US)

(73) Assignee: Arkwright, Incorporated, Fiskeville, RI (US)

( * ) Notice: Subject to any disclaimer, the term of this patent is extended or adjusted under 35 U.S.C. 154(b) by 0 days.

(21) Appl. No.: 09/450,671

(22) Filed: Nov. 30, 1999

Related U.S. Application Data

(60) Provisional application No. 60/110,228, filed on Nov. 30, 1998.

(51) Int. Cl.[7] ..... B41M 5/00

(52) U.S. Cl. ..... 428/195; 428/423.1; 428/522

(58) Field of Search ..... 428/195, 522, 428/423.1; 347/105

(56) References Cited

U.S. PATENT DOCUMENTS

| | | | |
|---|---|---|---|
| 3,816,838 | A | 6/1974 | Higaki et al. |
| 4,289,332 | A | 9/1981 | Kato |
| 4,436,789 | A | 3/1984 | Davis et al. |
| 4,460,637 | A | 7/1984 | Miyamoto et al. |
| 4,533,920 | A | 8/1985 | Suzuki |
| 4,680,235 | A | 7/1987 | Murakami et al. |
| 4,686,118 | A | 8/1987 | Arai et al. |
| 4,822,768 | A | 4/1989 | Ohga et al. |
| 4,889,765 | A | 12/1989 | Wallace |
| 4,892,787 | A | 1/1990 | Kruse et al. |
| 4,944,988 | A | 7/1990 | Yasuda et al. |
| 4,956,230 | A | 9/1990 | Edwards et al. |
| 4,959,661 | A | 9/1990 | Buxton et al. |
| 5,041,328 | A | 8/1991 | Akiya et al. |
| 5,126,010 | A | 6/1992 | Kobayashi et al. |
| 5,180,624 | A | 1/1993 | Kojima et al. |
| 5,213,873 | A | 5/1993 | Yasuda et al. |
| 5,270,103 | A | 12/1993 | Oliver et al. |
| 5,277,965 | A | 1/1994 | Malhotra |
| 5,330,824 | A | 7/1994 | Takimoto et al. |
| 5,378,534 | A | 1/1995 | Kuroanagi et al. |
| 5,445,866 | A | 8/1995 | Martinson et al. |
| 5,515,093 | A | 5/1996 | Haruta et al. |
| 5,518,821 | A | 5/1996 | Sakaki et al. |
| 5,522,968 | A | 6/1996 | Kuroyama et al. |
| 5,541,002 | A | 7/1996 | Hosoi et al. |
| 5,576,088 | A | 11/1996 | Ogawa et al. |
| 5,609,964 | A | 3/1997 | Ogawa et al. |
| 5,624,743 | A | 4/1997 | Malhotra |
| 5,635,297 | A | 6/1997 | Ogawa et al. |
| 5,662,997 | A | 9/1997 | Onishi et al. |
| 5,665,504 | A | 9/1997 | Malhotra |
| 5,670,242 | A | 9/1997 | Asano et al. |
| 5,672,424 | A | 9/1997 | Malhotra et al. |
| 5,683,793 | A | 11/1997 | Malhotra et al. |
| 5,686,508 | A | 11/1997 | Shimomura et al. |
| 5,686,602 | A | 11/1997 | Farooq et al. |
| 5,700,582 | A | 12/1997 | Sargeant et al. |
| 5,700,852 | A | 12/1997 | Iwanaga et al. |
| 5,707,722 | A | 1/1998 | Iqbal et al. |
| 5,709,976 | A | 1/1998 | Malhotra |
| 5,714,236 | A | 2/1998 | Withington et al. |
| 5,717,146 | A | 2/1998 | Ortiz |
| 5,729,265 | A | 3/1998 | Sakaki et al. |
| 5,747,148 | A | 5/1998 | Warner et al. |
| 5,751,325 | A | 5/1998 | Leenders et al. |
| 6,187,430 | B1 * | 2/2001 | Mukoyoshi et al. ..... 347/105 |

* cited by examiner

*Primary Examiner*—Pamela R. Schwartz
(74) *Attorney, Agent, or Firm*—Birch, Stewart, Kolasch & Birch, LLP

(57) ABSTRACT

The present invention relates to ink-jet recording media suitable for use with dye and pigmented inks. The media comprise a substrate coated with at least two ink-receptive layers. The upper layer comprises a modified poly(vinyl alcohol) compound and plasticizer, particularly a maleic or itaconic acid-modified poly(vinyl alcohol). The first ink-receptive layer may comprise a partially hydrolyzed poly (vinyl alcohol). The media can record high quality multi-colored images with minimal inter-color bleeding and pigmented ink cracking.

19 Claims, No Drawings

INK-JET RECORDING MEDIA HAVING INK-RECEPTIVE LAYERS COMPRISING MODIFIED POLY(VINYL ALCOHOLS)

CROSS-REFERENCE TO RELATED APPLICATIONS

This application claims the benefit of U.S. provisional application No. 60/110,228 having a file date of Nov. 30, 1998.

BACKGROUND OF THE INVENTION

1. Field Of the Invention

The present invention relates to inkjet recording media suitable for use with dye and pigmented inks. The media comprise a substrate coated with at least two ink-receptive layers. The upper layer comprises a modified poly(vinyl alcohol) compound. The media can record high quality multi-colored images with minimal inter-color bleeding and pigmented ink cracking.

2. Brief Description of the Related Art

In recent years, large (wide) format inkjet recording media have been widely used in outdoor applications such as commercial advertising displays. Outdoor printed media should be capable of projecting high quality multicolored images having good color density, brightness, and sharpness under a variety of weather conditions. Further, outdoor printed media should have good lightfastness and waterfastness.

Generally, most ink-jet recording media comprise a coated substrate such as a paper or polymeric film. Some ink-jet recording media are coated with ink-receptive compositions containing water-soluble polymers which are extremely water-absorptive. Inks used in ink-jet printing devices have traditionally consisted of molecular dyes carried in an aqueous-based ink vehicle. During imaging (i.e., printing), molecular dyes from the ink penetrate into the ink-receptive coating, leaving solvent to evaporate off the surface of the imaged media. Today, pigmented inks are replacing molecular dye-based inks. Pigmented-based inks have better light stability than molecular dye-based inks which is important for outdoor printed media. Pigmented inks comprise a pigmented colorant carried in an aqueous-based ink vehicle. Unlike molecular dyes, pigmented colorants generally bind to and accumulate on the surface of the medium resulting in uneven expansion of the ink-receptive coating. This expansion may cause pigmented ink cracks to appear in the final image. In addition, different colored inks may bleed together causing a loss in color sharpness and smearing.

Some ink-jet recording media are produced by coating a substrate with multiple layers containing various ingredients.

For example, Malhorta, U.S. Pat. No. 5,672,424 discloses a transparency sheet comprising an anionic layer that binds well with the substrate: and a second cationic layer situated on top of the anionic layer that binds with the anionic layer and comprised of cationic quaternary monomers and polymers thereof and a third ink-receiving layer situated on top of the second cationic layer and comprised of block copolymers and graft polymers, a biocide and a filler.

Malhorta, U.S. Pat. No. 5,683,793 discloses a transparency sheet comprising a first coating layer comprised of an ink-absorbing layer and biocide; and a second ink-spreading layer comprised of a hydrophilic vinyl binder, a dye mordant, a filler, and optional lightfastness inducing agent, and an ink spot size increasing agent.

Iqbal et al., U.S. Pat. No. 5,707,722 discloses an ink-jet recording sheet comprising a film substrate bearing on at least one major side surface thereon a two-layer imageable coating system wherein at least one of said layers is microporous, comprising: (1) an absorptive bottom layer comprising at least one crosslinkable polymeric component and at least one water-absorbing hydrophilic polymeric material, and (2) an optically clear top layer comprising at least one nonionic fluorocarbon surfactant having a hydrophilic portion and a hydrophobic portion, and at least one polymer selected from the group consisting of hydroxycellulose and substituted hydroxycellulose polymers, said top layer having been crosslinked on said film substrate by application of heat.

Warner, U.S. Pat. No. 5,747,148 discloses an ink-jet printing sheet having a particle-filled ink-receptor layer and a particle-filled protective-penetrant layer. The particles from both the ink-receptor layer and protective- penetrant layer cause protrusions from the protective penetrant layer.

Edwards et al., U.S. Pat. No. 4,956,230 discloses transparent sheets for use with ink-jet printers and pen plotters. The sheet comprises a transparent coating formed of a blend of at least one hydrophilic polymer containing a carbonylamido functional group and at least one hydrophobic polymer substantially free of acidic functional groups, hydroxyl groups, >NH groups and —$NH_2$ groups. Several hydrophilic polymers are disclosed such as e.g. poly(N-vinyl pyrrolidone), poly(methyloxazoline), poly(ethyloxazoline).

Sargeant et al., U.S. Pat. No. 5,700,582 discloses a polymer matrix coating used for ink-jet recording media that receives pigmented inks. The polymer matrix coating contains at least one water-soluble component such as poly(2-ethyl-2-oxazoline). The '582 Patent discloses that the polymer matrix coating avoids the problem of pigmented ink cracking.

Hosoi et al., U.S. Pat. No. 5,541,002 discloses a printing paper comprising a paper substrate and a coating layer. The coating comprises a white pigment and a water-soluble resin. The water-soluble resins include poly(vinyl alcohol) derivatives such as fully saponified poly(vinyl alcohol), partially saponified poly(vinyl alcohol), silanol group-modified vinyl alcohol copolymers and the like.

Onishi et al., U.S. Pat. No. 5,662,997 discloses an ink-jet recording film having an ink-receptive layer comprising a poly(vinyl alcohol) having a degree of saponification of 80 to 95% and a degree of polymerization of 1000 to 2000.

Kuroyama et al., U.S. Pat. No. 5,522,968 discloses an ink-jet recording paper having a pH of 6.0 to 8.0 in cold water extraction. The paper is made by applying an alkali metal salt to at least one surface of stack paper containing a filler such as kaolinite, illite, or plastic pigments.

There is a continuous need to develop ink-jet recording media that are capable of forming high quality multi-colored images with minimal inter-color bleeding and ink cracking using pigmented inks. The present invention provides such media.

SUMMARY OF THE INVENTION

The present invention relates to an ink-jet recording medium, suitable for recording images with dye and pigmented inks, comprising a substrate coated with a first ink-receptive layer and a second ink-receptive layer comprising a maleic or itaconic acid-modified poly(vinyl alcohol) and plasticizer. The second layer is coated onto the first layer. Suitable plasticizers phosphates, substituted phthalic anhydrides, glycerols, and glycols, particularly a glycerin trifunctional polyethylene glycol.

Preferably, the coating formulation of the second ink-receptive layer has a pH of no greater than 4.0 prior to being coated onto the first layer, and the pH may be adjusted by using a pH adjuster such as hydrochloric acid, organic hydrogen carboxylate, hydrogen phosphate, sodium hydrogen phthalate, or potassium hydrogen phthalate. The first and second layers may further comprise water-soluble and water-dispersible polymers such as partially hydrolyzed poly(vinyl alcohol), polyoxazoline (e.g., poly(2-ethyl-2-oxazoline) or poly(2-methyl-2-oxazoline) and polyurethanes such as a cationic aliphatic polyurethane, and mixtures thereof. The first layer may contain partially hydrolyzed poly(vinyl alcohol) and aliphatic cationic polyurethane in a ratio in the range of 0.5:1 to 10:1. Generally, in the second layer, the ratio of the maleic or itaconic acid-modified poly(vinyl alcohol) to cationic aliphatic polyurethane is in the range of 1.5:1 to 30:1. The first layer may further comprise an adhesion promoter such as a poly (ethyleneimine)-epichlorohydrin adduct. The first layer may also comprise maleic or itaconic acid-modified poly(vinyl alcohol).

The second layer may comprises a white pigment, organic particulates such as starch, polyolefins, poly(methyl methacrylates), polystyrenes, polytetrafluoroethylenes, and polyurethanes, and additives such as antifoam agents, surfactants, dyestuffs, optical brighteners, and mixtures thereof. Suitable substrates include papers and polymeric films. For example, plain, clay-coated, resin-coated, and latex-saturated papers may be used. Suitable polymeric films include polyvinyl chloride, polyethylene, polypropylene, polycarbonate, polyimide, polyester, and fluoroplastic films. The polymeric film may be transparent, translucent, matte, or opaque.

DETAILED DESCRIPTION OF THE INVENTION

The present invention relates to an ink-jet recording medium comprising a substrate coated with two ink-receptive layers. By the term "substrate", it is meant any suitable material that can be coated with the ink-receptive layers of this invention. For example, the substrate may be a paper such as a cellulose, synthetic-fiber, clay-coated, or polyolefin-coated paper. Alternatively, the substrate may be a polymeric film such as a film comprising polyethylene, polypropylene, polyester, naphthalate, polycarbonate, polysulfone, polyether sulfone, poly(arylene sulfone), cellulose triacetate, cellophane, polyvinyl chloride, polyvinyl fluoride, and/or polyimide. The thickness of the substrate is not limited and may vary according to particular applications of the medium.

The above substrates have two surfaces. The first surface, which is coated with the ink-receptive layers, is called the "front surface", and the opposite surface is called the "back surface" or underside. The chosen substrate may be pretreated, if so desired, by conventional techniques. For example, when the chosen substrate is a polymeric film substrate, a surface treatment, such as corona discharge or a primer coating, may be applied to one surface or both surfaces thereof. For a resin-coated paper substrate, the front and back surfaces may be treated by corona discharge. If a primer coating is used, the coating typically comprises a polymeric resin such as polyester, acrylic, epoxy, polyurethane, or the like, with polyurethane being preferred.

The front surface of the substrate, i.e., imaging surface, may be pretreated so that it will adhere better to the ink receiving coating. The back surface, i.e., non-imaging surface, may be pretreated in order to provide an adhesion promoting layer for a backing material. A backing material such as a polymeric resin, polymeric film, or paper may then be placed on the back surface in order to reduce electrostatic charge, sheet-to-sheet friction and, and curl of the substrate.

In the present invention, the front surface of the chosen substrate is coated with at least two ink-receptive layers. Generally, the first (i.e., bottom) ink-receptive layer is designed to quickly absorb ink vehicle fluids and the second (i.e., top) ink-receptive layer is designed to absorb ink while preventing pigmented ink cracks from developing in the images. The bottom layer also provides good adhesion to the front surface of the substrate. If the substrate's surface is not coated with the bottom ink-receptive layer of this invention, the top ink-receptive layer will not strongly adhere to the substrate. If the substrate is not coated with the top ink-receptive layer of this invention, pigmented ink cracks will develop in the images.

The first and/or second ink-absorbing layers may contain various polymeric binders for improving the film-forming properties of the coatings, quality of the printed images, and drying time of the ink (printed images). For example, water-soluble polymeric binders, such as poly(2-ethyl-2-oxazoline), poly(vinyl pyrrolidone), vinyl pyrrolidone copolymers, poly(ethylene oxide), starch, casein, sodium alginate, gelatin, gum arabic, and cellulose derivatives may be used. In addition, water-dispersible resins such as polyacrylates, polymethacrylates, polyurethanes, polyvinyl acetate, polyvinyl chloride, styrene, styrene and maleic acid anhydride copolymers may be used.

Preferably, the bottom ink-receptive layer comprises a partially hydrolyzed poly(vinyl alcohol) having a degree of hydrolysis of greater than 80%. A maleic or itaconic acid-modified poly(vinyl alcohol) is used in the second, upper layer. The partially hydrolyzed poly(vinyl alcohol) is more hydrophobic, while the maleic or itaconic acid-modified poly(vinyl alcohol) is more hydrophilic than conventional ("regular") poly(vinyl alcohol). Using maleic or itaconic acid-modified poly(vinyl alcohol) in the upper layer increases the elasticity of the upper layer making it more resistant to pigmented ink cracking. Maleic or itaconic acid-modified poly(vinyl alcohol) may also be present in the bottom layer.

In the present invention, blends containing poly(2-ethyl-2-oxazoline) (PEOX) in the bottom layer are preferred when the substrate is a polyethylene-coated paper, because PEOX adheres well to the paper, even when the surface of the paper does not have a primer coating.

A cationic polymer such as cationic aliphatic polyurethane may be incorporated into the first and/or second ink-receptive layers in order to modify the hydrophobicity/hydrophilicity of the layer(s). Typically, the ratio of poly (vinyl alcohol) (PVA) to polyurethane (PUR) is different in each layer. The first, bottom layer is more hydrophobic and the ratio of PVA/PUR is in the range of 0.5:1 to 10:1 and preferably 1.5:1. The second, top layer is more hydrophilic and the ratio of PVA/PUR is in the range of 1.5:1 to 30:1 and preferably 10:1. The right balance of hydrophobicity and hydrophilicity of the first and second layers allows the medium to work equally well with dye and pigmented inks.

The first and/or second ink-receptive layers may also comprise cationically-modified polymers which act as dye fixatives. The cationically-modified polymers are preferably water-soluble, compatible with the water-soluble or water dispersible polymeric binders, and have no adverse effect on image processing or colors in the image. Suitable examples of such water-soluble cationically-modified polymers, copolymers and their blends include polyquatemary ammonium salts, cationic polyamine, polyamidin, cationic acrylic copolymer, guanide-formaldehyde polymer, polydimethyldiallylammonium chloride (DMDAC), and diacetone acrylamide-dimethyldiallyl ammonium chloride. Polymers or copolymers may be used. The preferred polymer is a poly(ethyleneimine)-epichlorohydrin adduct which also improves the adhesion of the first layer to the base substrate.

Preferably, the second layer contains a plasticizer selected from the group consisting of phosphates, substituted phthalic anhydrides, glycerols, glycols, polyethylene glycols, substituted glycerols, and more preferably it is a glycerin trifunctional polyethylene glycol. The amount of the plasticizer is in the range 0.5 to 10 percent by weight based on weight of dry coating. The preferred amount is about 5 percent by weight. The first and/or second layers may also contain ink-absorbing pigments. Examples of white pigments useful in the second layer include kaolin, talc, clay, synthetic silica, calcium sulfate, precipitated calcium carbonate, ground calcium carbonate, calcium carbonate-compounded silica, satin white, aluminum oxide, aluminum silicate, colloidal silica, colloidal alumina, lithopone, zeolite, hydrated halloysite, magnesium hydroxide, magnesium carbonate, barium sulfate, titanium dioxide, zinc oxide, zinc sulfate, zinc carbonate, and white plastic pigments, such as styrene-based plastic pigments, acrylic plastic pigments, polyethylene, nicro-capsules, urea resin, and melamine resins.

The preferred pigment is a synthetic silica having an oil absorption in the range of about 150–400 gm/100 gm of pigment and preferably about 200–300 gm/100 gm of pigment. When the oil absorption is less than about 150 gm/100 gm, unacceptable ink absorption is typically found. On the other hand, poor ink density is typically observed when the oil absorption is greater than 400 gm/100 gm of the pigment. Preferably, the amount of pigment is in the range of 0.4 to 6 parts based on weight of polymeric binder(s) and more preferably in the range of 1 to 4 parts.

Other additives may be added to the first and/or second layers such as antifoam agents, surfactants, dyestuffs, optical brighteners, and the like.

It has been found that controlling the pH of the coating formulation for the second ink- receptive layer is important in controlling pigmented ink bleeding. Particularly, it has been found that the pH of the coating solution for the second ink-receptive layer should be no greater than 4.0 before it is coated onto the first layer. The pH of the coating formulation may be adjusted by the addition of conventional pH adjusters such as, for example, hydrochloric acid, organic hydrogen carboxylate, hydrogen phosphate, sodium hydrogen phthalate, and potassium hydrogen phthalate. Surprisingly, it was found that the pH of the underlayer had minimal effect on pigmented ink bleeding. While not wishing to be bound by any theory, one possible explanation to this phenomenon is that dispersing agents of the pigmented inks become more compatible with the top ink-receptive layer below a certain pH level, thereby allowing pigmented inks to better penetrate into the coating and bleeding is minimized.

Various coating methods may be employed in coating the substrate with the ink-receptive layers including Meyer-rod, air-knife, reverse-roll, and extrusion methods. The Meyer-rod coating method is preferred, because it is easy to use. The relatively low and consistent viscosity of the coating formulations of this invention is advantageous for coating applications. Generally, the dry coat weight on the substrate is in the range of about 2 to 30 grams/square meter, and the preferable weight is about 8–15 gm/sq.m. Less than about 2.0 gm/sq.m. dry coat weight may result in unacceptable print quality and penetration of the ink to the underside of the substrate.

The resulting multicolor ink-jet recording media may be imaged on various printers such as an EnCad Nova Jet PRO (dye inks: GA, GS and pigmented GO), Nova Jet III, and the HP 2000/HP 3000 series (dye and pigmented inks) or their equivalents, to provide images having dense, bright colors, sharp color-to-color boundaries, clean and bright backgrounds, freedom from feathering, water bleed-resistance, uniform color fill and good image resolution.

The present invention is further described by the following examples, but these examples should not be construed as limiting the scope of the invention. Ink-jet recording media samples were tested and evaluated using the following test methods.

Test Methods

The media samples were imaged and evaluated on large format EnCad (particularly Nova Jet PRO and Nova Jet PROe) and HP (HP2000 and HP750) printers with dye and pigmented inks. The printed media were evaluated for overall quality at 23° C. & 50% RH, 38° C. & 90% RH, representing southern Florida conditions, and 15° C. & 20% RH, representing winter conditions in northern states and Canada, and the results are reported below in Tables 1 and 2. Particularly, the samples were evaluated for pigmented ink cracking and inter-color bleeding and given a rating of 0 to 5 according to the following scales:

Pigmented Ink Cracking
0=No ink cracking
1=Slight cracking
2=Some cracking
3=Intermediate cracking
4=Considerable cracking
5=Heavy cracking Inter-Color Bleeding
0=No inter-color bleeding
1=Slight inter-color bleeding
2=Some inter-color bleeding
3=Intermediate inter-color bleeding
4=Considerable inter-color bleeding
5=Heavy inter-color bleeding

EXAMPLES

Example 1

An ink-jet recording medium having two ink-receptive layers was prepared as follows.

First (Bottom) Ink-Receptive Layer

The first ink-receptive layer was prepared as follows: 40 g of a 10% solution of poly(vinyl alcohol) having 87% hydrolysis (AIRVOL-523S, supplied by Air Products) were mixed with 12 g of a 10% solution of poly(2-ethyl-2-oxazoline (AQUAZOL 500, supplied by Polymer Chemistry Innovations). 9.50 g of cationic polyurethane (WITCOBOND 213, supplied by Witco, Inc.) were added drop-wise during intense mixing to prevent polymer complex formation and precipitation. 4 g of adhesion-promoter (LUPASOL SC 86X, supplied by BASF) were added next followed by 0.20 g of glutaric acid in 10 g of water and 0.5 g of flow additive (BYK 380, supplied by BYK Chemie). Water was added to adjust concentration and viscosity. The solution was stirred for an additional 20 minutes and is set forth below.

| Component | Weight % |
|---|---|
| Water | 33.8%* |
| Poly(vinyl alcohol), 87% hydrolysis, AIRVOL 523S, 10% solution | 40.0% |
| Poly(2-ethyl-2-oxazoline), AQUAZOL 500, 10% solution | 12.0% |
| Cationic aliphatic polyurethane, WITCOBOND 213 | 9.5% |
| Polyethyleneimine-epichlorohydrin LUPASOL SC 86X | 4.0% |
| Glutaric acid | 0.2% |
| BYK 380 | 0.5% |

*weight % based on weight of solution

Second (Top) Ink-Receptive Layer

The second ink-receptive layer was prepared as follows: 58 g of a 10% solution of maleic acid-modified poly(vinyl alcohol) (KM-118, supplied by Kuraray, Inc., Japan) were mixed with 5.7 g of a 10% solution of poly(2-ethyl-2-oxazoline) (AQUAZOL 500, supplied by Polymer Chemistry Innovations) and 1.4 g of poly(vinyl pyrrolidone) (K-60, supplied by ISP). 2.4 g of cationic polyurethane (WITCOBOND 213, supplied by Witco, Inc.) were added drop-wise during intense mixing to prevent polymer complex formation and precipitation. 0.45 g of a plasticizer (CARBOWAX TPEG, supplied by Union Carbide) were added next, followed by 0.25 g of glutaric acid in 10 g of water and 0.5 g of flow additive (BYK 380, supplied by BYK Chemie). Water was added to adjust concentration and viscosity. Hydrochloric acid was added to adjust the pH to a level in the range of 3.0 to 3.5. The solution was stirred for an additional 20 minutes and is set forth below.

| Component | Weight % |
|---|---|
| Water | 31.3%* |
| Maleic acid-modified poly(vinyl alcohol), KM-618, 10% solution | 58.0% |
| Poly(vinyl pyrrolidone), PVP K-60, 45% solution | 1.4% |
| Poly(2-ethyl-2-oxazoline), AQUAZOL 500, 10% solution | 5.7% |
| Cationic aliphatic polyurethane, WITCOBOND 213 | 2.4% |
| Glycerin trifunctional polyethylene glycol, CARBOWAX TPEG | 0.5% |
| Glutaric acid | 0.3% |
| BYK 380 | 0.5% |
| Hydrochloric acid, pH adjustment to 3.0–3.5 | |

*weight % based on weight of solution

The above-described formulations were coated onto a polyethylene-coated paper using a Meyer rod and the paper was dried at 120° C. for 1.5 minutes. The dry coat weight of each ink-jet receptive layer was 4 to 5 g/m$^2$. Other samples were prepared using the above-described formulations, where the pH of the second layer coating solutions was adjusted to different pH levels. The samples were evaluated for inter-color bleeding and pigmented ink cracking. The results are shown below in Table 1.

TABLE 1

| PIGMENTED INKS | | | | | | | |
|---|---|---|---|---|---|---|---|
| PH | 7.2 | 6.4 | 5.4 | 4.5 | 3.5 | 3.0 | 2.0 |
| Inter-Color Bleeding | 5 | 5 | 4 | 3 | 0 | 0 | 1 |
| Ink Cracking | 0 | 0 | 0 | 0 | 0 | 0 | 0 |

Example 2

An ink-jet recording medium having two ink-receptive layers was prepared as follows.

First (Bottom) Ink-Receptive Layer

The first ink-receptive layer was prepared as described above in Example 1.

Second (Top) Ink-Receptive Layer

The second ink-receptive layer was prepared as described above in Example 1.

Example 3

An ink-jet recording medium having two ink-receptive layers was prepared as follows.

First (Bottom) Ink-Receptive Layer

The first ink-receptive layer was prepared as described above in Example 1.

Second (Top) Ink-Receptive Layer

The second ink-receptive layer was prepared using the formulation set forth below.

| Component | Weight % |
|---|---|
| Water | 35.6%* |
| Maleic acid-modified poly(vinyl alcohol), KM-118, 10% solution | 60.0% |
| Poly(vinyl pyrrolidone), PVP K-60, 45% solution | 2.4% |
| Poly(vinyl acetate)/acrylic polymer R-530 (Plasticizer) | 1.3% |
| Glutaric acid | 0.2% |
| BYK 380 | 0.5% |
| Hydrochloric acid, pH adjustment (see Table 2) | |

*weight % based on weight of solution

Example 4

An ink-jet recording medium having two ink-receptive layers was prepared as follows.

First (Bottom) Ink-Receptive Layer

The first ink-receptive layer was prepared as described above in Example 1.

Second (Top) Ink-Receptive Layer

The second ink-receptive layer was prepared by mixing the formulation set forth below.

| Component | Weight % |
|---|---|
| Water | 23.0%* |
| Maleic acid-modified poly(vinyl alcohol), KM-618, 10% solution | 60.0% |
| Poly(2-ethyl-2-oxazoline), AQUAZOL 500, 10% solution | 13.0% |
| Cationic aliphatic polyurethane, WITCOBOND 213 | 2.0% |
| Glycerin trifunctional polyethylene glycol, | 0.9% |

-continued

| Component | Weight % |
|---|---|
| CARBOWAX TPEG | |
| Acrylic Latex SC-5174 | 0.9% |
| Glutaric acid | 0.2% |
| BYK 380 | 0.5% |
| Hydrochloric acid, pH adjustment (see Table 2) | |

*weight % based on weight of solution

Comparative Example 1

An ink-jet recording medium having two ink-receptive layers was prepared as follows.

First (Bottom) Ink-Receptive Layer

The first ink-receptive layer was prepared as described above in Example 1.

Second (Top) Ink-Receptive Layer

The second ink-receptive layer was prepared by mixing the formulation set forth below.

| Component | Weight % |
|---|---|
| Water | 34.9%* |
| Maleic acid-modified poly(vinyl alcohol), KM-618, 10% solution | 60.0% |
| Poly(vinyl pyrrolidone), PVP K-60, 45% solution | 2.4% |
| Cationic aliphatic polyurethane, WITCOBOND 213 | 2.0% |
| Glutaric acid | 0.2% |
| BYK 380 | 0.5% |
| Hydrochloric acid, pH adjustment (see Table 2) | |

*weight % based on weight of solution

Comparative Example 2

An ink-jet recording medium having two ink-receptive layers was prepared as follows.

First (Bottom) Ink-Receptive Layer

The first ink-receptive layer was prepared as described above in Example 1.

Second (Top) Ink-Receptive Layer

The second ink-receptive layer was prepared using the formulation set forth below.

| Component | Weight % |
|---|---|
| Water | 34.1%* |
| Maleic acid-modified poly(vinyl alcohol), KM-618, 10% solution | 60.0% |
| Poly(vinyl pyrrolidone), PVP K-60, 45% solution | 2.4% |
| Cationic aliphatic polyurethane, WITCOBOND 213 | 2.0% |
| CARBOWAX 200 | 0.4% |
| Glutaric acid | 0.2% |
| BYK 380 | 0.5% |
| Hydrochloric acid, pH adjustment (see Table 2) | |

*weight % based on weight of solution

Comparative Example 3

An ink-jet recording medium having two ink-receptive layers was prepared as follows.

First (Bottom) Ink-Receptive Layer

The first ink-receptive layer was prepared as described above in Example 1.

Second (Top) Ink-Receptive Layer

The second ink-receptive layer was prepared using the formulation set forth below.

| Component | Weight % |
|---|---|
| Water | 34.9%* |
| Poly(vinyl alcohol), 87% hydrolysis, AIRVOL 523S, 10% solution | 60.0% |
| Poly(vinyl pyrrolidone), PVP K-60, 45% solution | 2.4% |
| Cationic aliphatic polyurethane, WITCOBOND 213 | 2.0% |
| Glutaric acid | 0.2% |
| BYK 380 | 0.5% |
| Hydrochloric acid, pH adjustment (see Table 2) | |

*weight % based on weight of solution

Comparative Example 4

An ink-jet recording medium having two ink-receptive layers was prepared as follows.

First (Bottom) Ink-Receptive Layer

The first ink-receptive layer was prepared as described above in Example 1.

Second (Top) Ink-Receptive Layer

The second ink-receptive layer was prepared using the formulation set forth below.

| Component | Weight % |
|---|---|
| Water | 23.0%* |
| Maleic acid-modified poly(vinyl alcohol), KM-618, 10% solution | 60.0% |
| Poly(2-ethyl-2-oxazoline), AQUAZOL 500, 10% solution | 13.0% |
| Cationic aliphatic polyurethane, WITCOBOND 213 | 2.0% |
| Glycerin trifunctional polyethylene glycol, CARBOWAX TPEG | 0.9% |
| Acrylic Latex SC-5174 | 0.9% |
| Glutaric acid | 0.2% |
| BYK 380 | 0.5% |
| Hydrochloric acid, pH adjustment (see Table 2) | |

*weight % based on weight of solution

Comparative Example 5

An ink-jet recording medium having two ink-receptive layers was prepared as follows.

First (Bottom) Ink-Receptive Layer

The first ink-receptive layer was prepared as described above in Example 1.

Second (Top) Ink-Receptive Layer

The second ink-receptive layer was prepared using the formulation set forth below.

| Component | Weight % |
|---|---|
| Water | 39.8%* |
| Maleic acid-modified poly(vinyl alcohol), KM-618, 10% solution | 55.0% |
| Poly(vinyl pyrrolidone), PVP K-60, 45% solution | 3.8% |

-continued

| Component | Weight % |
|---|---|
| Gelatin KNK 7314 | 0.8% |
| Saponin | 0.6% |
| Glutaric acid | 0.2% |
| BYK 380 | 0.5% |
| Hydrochloric acid, pH adjustment (see Table 2) | |

*weight % based on weight of solution

The above-described formulations (Examples 2–4 and Comparative Examples 1–5) were coated onto polyethylene-coated photobase papers using Meyer rods and the papers were dried at about 120° C. for about 1.5 minutes. The dry coat weight of each ink-jet receptive layer was about 4 to 5 g/m$^2$. The paper media were then imaged and tested in accordance with the above Test Methods and the results are reported below in Table 2.

The qualities of the printed images using dye inks were good for all samples including comparative samples. However, there were significant differences with the quality of the printed images when pigmented inks were used. Primarily, when the pH of the top ink-receptive layer was 4.0 or greater (Comp. Ex. 1–5), the overall quality of the printed image was poor and significant pigmented ink cracking was observed. As shown in Comp. Ex.. 3, when AIRVOL 523 (regular poly(vinyl alcohol) was used in place of KM-618 or KM-118 modified poly(vinyl alcohol), print quality deteriorated, and pigmented ink cracking was observed. When formulations containing no plasticizers were used (Comp. Exs. 1 and 5), pigmented ink cracking was observed. In Comp.Ex. 2, CARBOWAX 200 (a linear low molecular weight polyoxyethylene) was used in place of CARBOWAX TPEG (a glycerine-type polyoxyethylene), and some pigmented ink cracking was observed.

TABLE 2

PIGMENTED INKS

| Example | 1 | 2 | 3 | 4 | C1 | C2 | C3 | C4 | C5 |
|---|---|---|---|---|---|---|---|---|---|
| Coat weight, g/m$^2$ | 13 | 13 | 13 | 10 | 10 | 10 | 10 | 10 | 10 |
| PH | 3.5 | 3.7 | 3.0 | 3.5 | 4.2 | 4.2 | 4.2 | 4.2 | 4.0 |
| Inter-Color Bleed | 0 | 0 | 0.5 | 0 | 3.5 | 3 | 3.5 | 2.5 | 0.5 |
| Cracks | 0 | 0 | 0 | 0 | 0.2 | 0.5 | 3.5 | 1 | 1 |
| Overall Quality | good | good | fair | good | bad | Bad | bad | bad | bad |

We claim:

1. An ink-jet recording medium, suitable for recording images with dye and pigmented inks, comprising a substrate coated with a first ink-receptive layer comprising a partially hydrolyzed poly(vinyl alcohol) and a second ink-receptive layer comprising a maleic or itaconic acid-modified poly (vinyl alcohol) and plasticizer, said second layer being coated onto said first layer.

2. The ink-jet recording medium of claim 1, wherein a coating formulation for the second ink-receptive layer has a pH of no greater than 4.0 prior to being coated onto the first layer.

3. The ink-jet recording medium of claim 2, wherein the pH of the coating formulation is adjusted to a pH of no greater than 4.0 by the addition of a compound selected from the group consisting of hydrochloric acid, organic hydrogen carboxylate, hydrogen phosphate, sodium hydrogen phthalate, potassium hydrogen phthalate, and mixtures thereof to the formulation.

4. The ink-jet recording medium of claim 1, wherein the first and second layers comprise water-soluble polymers.

5. The ink-jet recording medium of claim 4, wherein the water-soluble polymer is poly(2-ethyl-2-oxazoline) or poly (2-methyl-2-oxazoline).

6. The ink-jet recording medium of claim 4, wherein the first layer comprises a mixture of a partially hydrolyzed poly(vinyl alcohol) and cationic aliphatic polyurethane and the ratio of the partially hydrolyzed poly(vinyl alcohol) to cationic aliphatic polyurethane is in the range of 0.5:1 to 10:1.

7. The ink-jet recording medium of claim 4, wherein the first layer further comprises poly(ethyleneimine)-epichlorohydrin adduct.

8. The ink-jet recording medium of claim 4, wherein the second layer comprises a mixture of a maleic or itaconic acid-modified poly(vinyl alcohol) and cationic aliphatic polyurethane and the ratio of the maleic or itaconic acid-modified poly(vinyl alcohol) to cationic aliphatic polyurethane is in the range of 1.5:1 to 30:1.

9. The ink-jet recording medium of claim 1, wherein the first and second layers comprise water-dispersible polymers.

10. The ink-jet recording medium of claim 9, wherein the water-dispersible polymer is a cationic aliphatic polyurethane.

11. The ink-jet recording medium of claim 1, wherein the plasticizer in the second layer is selected from the group consisting of phosphates, substituted phthalic anhydrides, glycerols, and glycols.

12. The ink-jet recording medium of claim 11, wherein the plasticizer is a glycerin trifunctional polyethylene glycol.

13. The ink-jet recording medium of claim 1, wherein the second layer further comprises a white pigment.

14. The ink recording medium of claim 1, wherein the second layer further comprises organic particulates selected from the group consisting of starch, polyolefins, poly (methyl methacrylates), polystyrenes, polytetrafluoroethylenes, and polyurethanes.

15. The ink-jet recording medium of claim 1, wherein the second layer further comprises additives selected from the group consisting of antifoam agents, surfactants, dyestuffs, optical brighteners, and mixtures thereof.

16. The ink-jet recording medium of claim 1, wherein the substrate is a paper or polymeric film.

17. The ink-jet recording medium of claim 16, wherein the substrate is a paper selected from the group consisting of plain, clay-coated, resin-coated, and latex-saturated papers.

18. The ink-jet recording medium of claim 16, wherein the substrate is a polymeric film selected from the group consisting of polyvinyl chloride, polyethylene, polypropylene, polycarbonate, polyimide, polyester, and fluoroplastic films.

19. The inkjet recording medium of claim 18, wherein the polymeric film is transparent, translucent, matte, or opaque.

* * * * *